US006513164B1

(12) United States Patent
Hearns

(10) Patent No.: US 6,513,164 B1
(45) Date of Patent: Feb. 4, 2003

(54) BABY BLANKET ASSEMBLY

(76) Inventor: Renee Burnadette Hearns, 20551 S. Horwood, Southfield, MI (US) 48075

( * ) Notice: Subject to any disclaimer, the term of this patent is extended or adjusted under 35 U.S.C. 154(b) by 0 days.

(21) Appl. No.: 09/952,963

(22) Filed: Sep. 14, 2001

(51) Int. Cl.[7] ..... A47G 9/00
(52) U.S. Cl. ..... 2/69.5; 5/419
(58) Field of Search ..... 2/69.5, 69, 75, 2/83, 89; 5/494, 431, 419, 655; 297/465, 485

(56) References Cited

U.S. PATENT DOCUMENTS 3,579,675 A * 5/1971 Scheer
4,087,874 A * 5/1978 Callaway et al. ..... 5/343
4,236,263 A * 12/1980 Allee ..... 5/413
4,316,287 A * 2/1982 Rule ..... 2/69.5
4,458,372 A * 7/1984 Mills ..... 5/413
4,739,529 A * 4/1988 Mills ..... 5/413
4,774,734 A * 10/1988 Mills ..... 5/413
D300,681 S * 4/1989 DeMars ..... D2/25
4,856,131 A * 8/1989 Mills ..... 5/413
4,874,344 A * 10/1989 Kanter ..... 446/268
5,014,376 A * 5/1991 Doran et al. ..... 5/431
5,093,947 A * 3/1992 Henegar et al. ..... 5/482
5,131,096 A * 7/1992 Olson ..... 2/75
5,193,235 A * 3/1993 Kircher ..... 5/413
5,933,886 A * 8/1999 Washington ..... 5/494
6,145,932 A * 11/2000 Hamel-Nyhus et al. ..... 297/465
6,343,968 B1 * 2/2002 Louie et al. ..... 446/72

* cited by examiner

*Primary Examiner*—Gloria M. Hale
*Assistant Examiner*—Alissa L. Hoey
(74) *Attorney, Agent, or Firm*—Law Offices of John G. Chupa and Associates, P.C.

(57) ABSTRACT

A baby blanket assembly 10 which includes a support portion 12 and a cover portion 14 which may be selectively attached to the support portion 12 to cooperatively form a baby containment pouch 24. The baby blanket assembly 12 may include a pacifier 25 and a burp cloth 34 in addition to a breathing sensor, a sound device, and/or a motion sensor.

18 Claims, 2 Drawing Sheets

BABY BLANKET ASSEMBLY

FIELD OF THE INVENTION

The present invention generally relates to a baby blanket assembly and more particularly to a baby blanket assembly which securely and removably receives a baby and which provides a safe and comfortable environment for the baby to sleep and rest.

BACKGROUND OF THE INVENTION

A baby blanket typically comprises a one-piece relatively small and generally flat cover which is typically wrapped around a baby. While the foregoing blanket does allow a baby to be kept relatively warm, it suffers from some drawbacks. For example and without limitation, the blanket does not reliably secure the baby within the blanket and, in fact, is frequently tossed aside by the baby, thereby causing the baby to be cold and uncomfortable. Further, the blanket may also be undesirably moved to cover the face of the baby, thereby increasing the likelihood of suffocating the baby or undesirably restricting the amount of oxygen which is communicated to the baby, thereby otherwise damaging the baby. The blanket also fails to provide a warning to the parents or other interested interested individuals of the undesired movement of the baby or of a loss of or interruption of breathing. The present invention overcomes some or all of these aforedescribed drawbacks in a new and novel manner and comprises a new useful baby blanket assembly.

SUMMARY OF THE INVENTION

It is a first non-limiting advantage of the present invention to provide a baby blanket assembly which overcomes some or all of the previously delineated drawbacks associated with prior baby blankets.

It is a second non-limiting advantage of the present invention to provide a baby blanket assembly which overcomes some or all of the drawbacks associated with prior baby blankets and which, by way of example and without limitation, provides a baby retention pouch which securely positions and/or retains the baby within the baby blanket assembly.

It is a third non-limiting advantage of the present invention to provide a baby blanket assembly which overcomes some or all of the drawbacks associated with prior baby blankets and which, by way of example and without limitation, detects the presence and movement of a baby residing within the baby blanket assembly.

According to a first non-limiting aspect of the present invention, a baby blanket assembly is provided and includes a first support portion; a second cover portion; a fastener which selectively couples the second cover portion to the first support portion including a first selectively raised portion and a pouch; a burp cloth which is removably secured within the first selectively raised portion; and a pacifier which is removably placed within the pouch.

According to a second non-limiting aspect of the present invention, a baby blanket assembly is provided and includes a first generally flat portion having a raised head support; a second portion which is removably attached to the first portion and which cooperates with the first generally flat portion to form a baby containment pouch which extends from below the head support to one end of the first generally flat portion, the second portion having a width which is greater than the width of the first portion; and a sound device which is removably and operatively disposed within the second portion.

According to a third aspect of the present invention, a baby blanket assembly is provided and includes a generally rectangular and selectively foldable first support portion having an attractive display which is disposed upon a first surface of the first support portion and which further includes a motion detector assembly and a raised head support portion; a second cover portion which is selectively attached to the first support portion and which cooperates with the first support portion to form a baby containment pouch, the second cover portion further including a breathing detector assembly which detects the occurrence of breathing by a baby and a pouch.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

Figure 1:
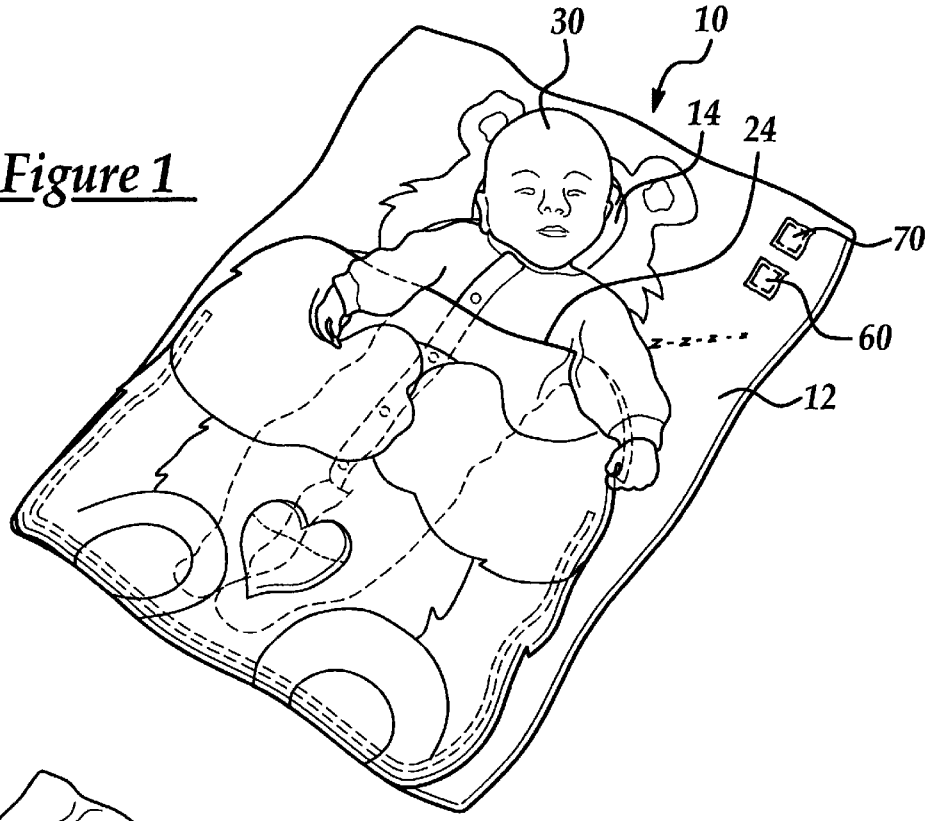
FIG. 1 is a perspective view of a baby blanket assembly which is made in accordance with the teachings of the preferred embodiment of the invention in combination with a baby.
Figure 2:
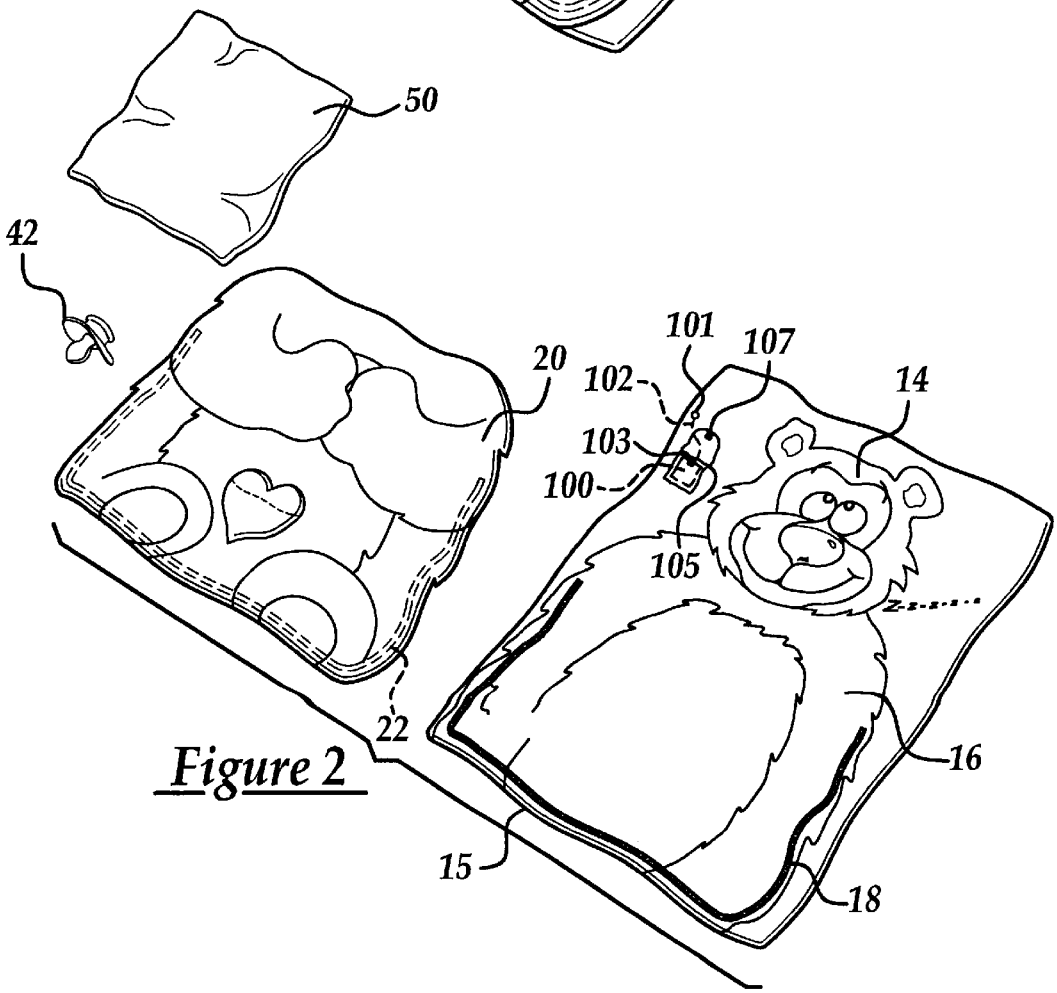
FIG. 2 is an unassembled perspective view of the baby blanket assembly which is shown in FIG. 1.

Referring now to FIGS. 1–4, there is shown a baby blanket assembly 10 which is made in accordance with the teachings of the preferred embodiment of the invention.

As shown, baby blanket assembly 10 includes a generally flat and relatively soft baby support portion 12 which, in one non-limiting embodiment of the invention, is generally rectangular and selectively foldable. In other non-limiting embodiments of the invention, the support portion 12 may be triangular or substantially any other desired shape or configuration. As shown, support portion 12 includes a raised and padded head support portion 14 which forms part of a decorative design or insignia 16, and a fastening member in the form of a Velcro® type strip 18 which is disposed around a portion of the periphery of the support portion 12 which resides below the padded head rest 14 (e.g., between the end 15 opposite of the head rest 14 and the head rest 14).

Baby assembly 12 further includes a second or "cover" portion 20 having a fastening member in the form of a Velcro® strip 22 which is complementary to the strip 18 (e.g., the term "complementary" means that the strip 22 may selectively and removably adhere to the strip 18) and which is disposed around a portion of the periphery of the cover portion 20 below the head rest portion 14.

Figure 3:
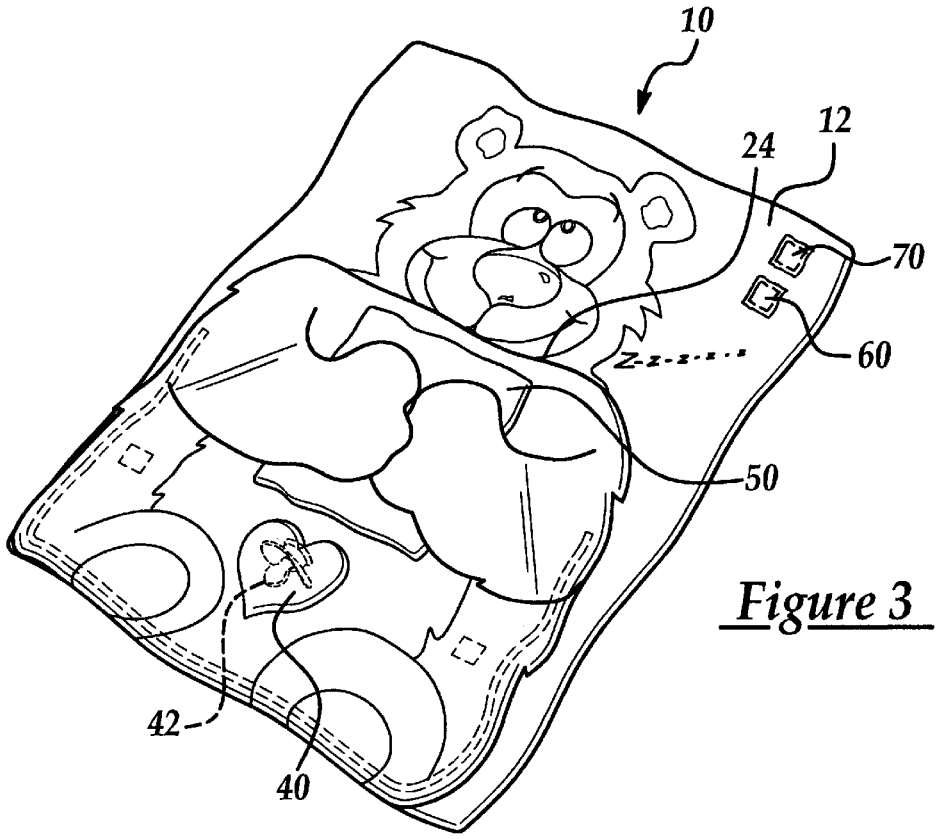
FIG. 3 is perspective view of the baby blanket assembly which is shown in FIGS. 1 and 2.
Figure 4:
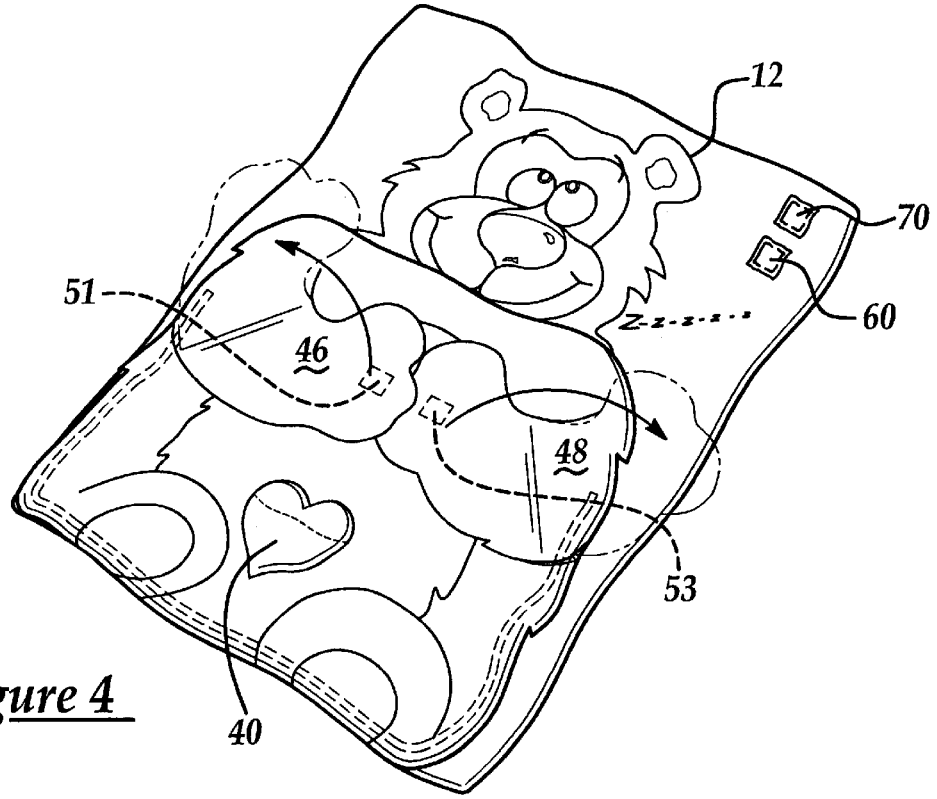
FIG. 4 is a view similar to that which is shown in FIG. 3 but illustrating the selective engagement of a portion of the baby blanket assembly.

As shown best in FIGS. 1, 3, and 4, the fastening member 22 is adapted to be selectively attached to the fastening member 18, thereby cooperatively allowing the portions 12 and 20 to form a baby retention pouch 24 into which a baby 30 may be selectively and snugly inserted or which may be formed after the baby 30 has been placed upon the support portion 12 (e.g., the baby 30 may be initially placed upon the support portion 12 and the cover 20 may be placed over the baby while adhered to the support portion 12 by the complementary fastens 18, 22). The pouch 24 extends from the end 15 to just below the padded head rest 14. Importantly, the support portion 12 is substantially wider than the cover portion 20 in order to allow the cover portion 20 to be selectively "wrapped around" the baby 30 as the baby 30 is being carried.

The cover portion 20 further includes a heart shaped pouch 40 into which a pacifier 42 may be selectively and removably placed and two substantially identical portions, in the form of hands or arms 46, 48 which may be selectively engaged to receive a burp cloth 50. That is, each arm 46, 48 may respectively have or complementary faster member 51, 53 which may engage and secure the burp cloth 50 upon the cover portion 20.

Further, in one non-limiting embodiment, the blanket assembly 12 includes a self-powered or battery operated sound device 100 which may be selectively contained within either the support portion 12 or the cover portion 20 and which is adapted to generate a certain sound, such as the sound of a mother's womb. That is, device 100 may be coupled to a switch 101 by a bus 102 which is "threaded through" or traverses the support portion 12. Switch 101 protrudes from the blanket assembly 10 and allows the device 100 to be selectively activated and deactivate when the switch 101 is respectively depressed a first and then a second time. In one non-limiting embodiment, device 100 is placed within a selectively accessible pouch 103 which is formed within the cover portion 12 (e.g., pouch 103 is selectively closed by a pain of complementary fasteners or clasps 105, 107 or opened allowing the device 100 to be removed and serviced). That is, fastener 105 is disposed upon support portion 12 and fastener 107 is disposed upon the top surface of the pouch and is adapted to selectively engage and disengage the fastener 105 to allow access to pouch 103. In another non-limiting embodiment of the invention, the sounding device 100 may be programmable and adapted to receive, record, and to replay substantially any desired sound, such as but not limited to a mother's voice. Further, in other non-limiting embodiments of the invention, the baby blanket assembly 10 may include a self-powered or battery operated motion detector 60, such as those utilized in vehicle security systems, which may be selectively and removably received within the support portion 12 or the cover portion 14 in the same manner that device 100 resides within portions 12, 20 and which is adapted to sense the movement of the baby 30 from the blanket 12 and to generate an audible warning sound. Further, in yet another non-limiting embodiment of the invention, the baby blanket assembly 12 may include a self-powered or battery powered breathing sensor 70 which may be operatively placed within the support portion 12 in the same manner that device 100 resides within the support portion 12 in close proximity to the head of the baby 30 and which is adapted to detect any discontinuity or stoppage of breathing from the baby 30 and to generate an audible warning signal, thereby informing the parents and other interested individuals of a stoppage or discontinuity of the breathing of the baby 30. In one embodiment, sensor 70 may comprise an oxygen sensor or be adapted to programmably receive a certain pre-recorded sound of the noise made by the sleeping baby 30 and to compare this stored noise in order to determine whether the baby 30 remained sleeping.

It is to be understood that the invention is not limited to the exact construction and method which has been illustrated above, but that various changes and modifications may be made without departing from the spirit and the scope of the invention as is delineated within the following claims. It should be appreciated that the blanket assembly 10 allows a baby 30 to be securely positioned within the assembly 10, thereby reducing or substantially eliminating the likelihood of suffocation or damage caused from a lack of oxygen and further provides an aesthetically pleasing overall appearance while providing positive confirmation of the movement of the baby 30 from the assembly 12 or the loss of breathing while further providing a pleasing and restful sound to the baby 30. Moreover, the selectively detachable and foldable nature of the portions 12 and 20 allow the assembly 10 to be easily stored and transported.

What is claimed is:

1. A baby blanket assembly comprising a first foldable support portion; a second foldable cover portion having a pouch and a pair of substantially identical arm portions, wherein each of said arm portion include a fastening member effective to hold each of said arms to said second cover portion; a fastener which selectively couples said second cover portion to said first support portion; a burp cloth which is removably secured to said second cover portion by said pair of substantially identical arm portions; and a pacifier which is removably placed within said pouch.

2. The baby blanket assembly of claim 1 further comprising a sound device which is contained within said first support portion.

3. The baby blanket assembly of claim 1 further comprising a sound device which is operatively contained within said second cover portion.

4. The baby blanket assembly of claim 1 wherein said cover portion has a width which is greater than said first support portion.

5. The baby blanket assembly of claim 4 wherein said cover portion and said support portion are each substantially flat.

6. The baby blanket assembly of claim 5 wherein said sound device is adapted to emit the sound of a mother's womb.

7. The baby blanket assembly of claim 5 further comprising an breath sensing device which is adapted to detect the breathing of a baby.

8. The baby blanket of claim 7 wherein said breath sensing device includes a second portion which emits an audible warning signal in the event that breathing is undetected.

9. A baby blanket assembly comprising a first generally flat portion having a raised head support; a second portion which is removably attached to said first portion and which cooperates with said first generally flat portion to form a baby containment pouch which extends from below the head support to one end of said first generally flat portion, said second portion having a width which is greater than the width of said first portion and a pair of substantially identical arm portions which cooperate to selectively hold a burp cloth to said second portion; and a sound emitting device which is removably and operatively disposed within said second portion.

10. The baby blanket assembly of claim 9 wherein said sound emitting device creates the sound of a mother's womb.

11. The baby blanket assembly of claim 9 wherein said sound emitting device is a programmable device which programmably receives a certain sound and which selectively emits said certain sound.

12. The baby blanket assembly of claim 9 further comprising a sound detecting device which detects the sound of breathing.

13. The baby blanket assembly of claim 12 wherein said sound detecting device includes an alarm which is activated when breathing is undetected.

14. The baby blanket assembly of claim 9 wherein said sound emitting device creates the sound of a mother's voice.

15. The baby blanket assembly of claim 14 further comprising a pressure sensor which detects a departure of a baby from the baby containment pouch and which selectively emits a warning signal upon said departure.

16. A baby blanket assembly comprising a generally rectangular and selectively foldable first support portion having an attractive display which is disposed upon a first surface of said first support portion and which further includes a motion detector assembly and a raised head support portion; a second cover portion which is selectively attached to said first support portion and which cooperates with said first support portion to form a baby containment pouch, said second cover portion further including a breathing detector assembly which detect the occurrence of breathing by a baby and a pouch.

17. The baby blanket assembly of claim 16 further comprising a burp cloth which is removably contained within said pouch.

18. The baby blanket assembly of claim 17 further comprising a pacifier which is removably contained within said pouch.

* * * * *